US007392806B2

(12) United States Patent
Yuen et al.

(10) Patent No.: US 7,392,806 B2
(45) Date of Patent: Jul. 1, 2008

(54) ELECTRONIC HUMAN BREATH FILTRATION DEVICE

(76) Inventors: Peter Siltex Yuen, 2765 Henessy Dr., San Jose, CA (US) 95148; Bessie M Yuen Chan, 46875 Shale Common, Fremont, CA (US) 94539-8109

( * ) Notice: Subject to any disclaimer, the term of this patent is extended or adjusted under 35 U.S.C. 154(b) by 384 days.

(21) Appl. No.: 10/428,026

(22) Filed: Apr. 30, 2003

(65) Prior Publication Data

US 2004/0216745 A1 Nov. 4, 2004

(51) Int. Cl.
*A62B 9/04* (2006.01)

(52) U.S. Cl. ..... 128/205.27

(58) Field of Classification Search ..... 128/205.27, 128/205.29, 206.12, 206.14, 206.16, 206.21, 128/206.28; 55/DIG. 33, DIG. 35; 96/16, 96/77, 96, 97, 54, 57, 59
See application file for complete search history.

(56) References Cited

U.S. PATENT DOCUMENTS

| | | | | | |
|---|---|---|---|---|---|
| 2,381,455 | A * | 8/1945 | Jacob | 96/16 |
| 3,702,526 | A * | 11/1972 | Eichmeier | 96/16 |
| 3,724,174 | A * | 4/1973 | Walkenhorst | 96/54 |
| 3,973,927 | A * | 8/1976 | Furchner et al. | 95/3 |
| 4,077,784 | A * | 3/1978 | Vayrynen | 96/88 |
| 4,518,401 | A * | 5/1985 | Pontius et al. | 96/15 |
| 4,573,464 | A * | 3/1986 | Yo | 128/206.15 |
| 5,010,777 | A * | 4/1991 | Yehl et al. | 73/864.81 |
| 5,038,775 | A * | 8/1991 | Maruscak et al. | 128/205.27 |
| 5,133,788 | A * | 7/1992 | Backus | 55/467 |
| 5,376,168 | A * | 12/1994 | Inculet | 96/54 |
| 5,647,890 | A * | 7/1997 | Yamamoto | 95/69 |
| 5,666,949 | A * | 9/1997 | Debe et al. | 128/202.22 |
| 5,749,359 | A * | 5/1998 | Hansen | 128/205.25 |
| 6,042,637 | A * | 3/2000 | Weinberg | 96/58 |
| 6,118,645 | A * | 9/2000 | Partridge | 361/231 |
| 6,623,544 | B1 * | 9/2003 | Kaura | 95/3 |
| 6,901,930 | B2 * | 6/2005 | Henley | 128/205.27 |
| 2003/0136408 | A1 * | 7/2003 | Henley | 128/205.29 |

* cited by examiner

*Primary Examiner*—Steven O Douglas

(57) ABSTRACT

A battery powered portable human body carrying electronic human breath filtration device is an electronic nose mask and is the most ideal alternative to conventional filter paper type nose mask. It utilizes electronic ionization technique and electrostatic field to remove air borne particles, dust, pollens, contaminants, bacteria, viruses, toxic chemical, fume and tobacco smoke from human inhalation and exhalation breath. It interacts with human breathing action as the air flow driving system to move the inhalation and exhalation breaths through the electronic filter elements, in addition to a front louver cover and a rear louver cover's protection as pre-filters. The system requires very low running current and uses small batteries usually found in household electronics. This filtration system is light weight with negligible air flow resistance and is integrated into the nose mask which is connected to a pocket size control system via a connection cable.

28 Claims, 6 Drawing Sheets

FIG 5
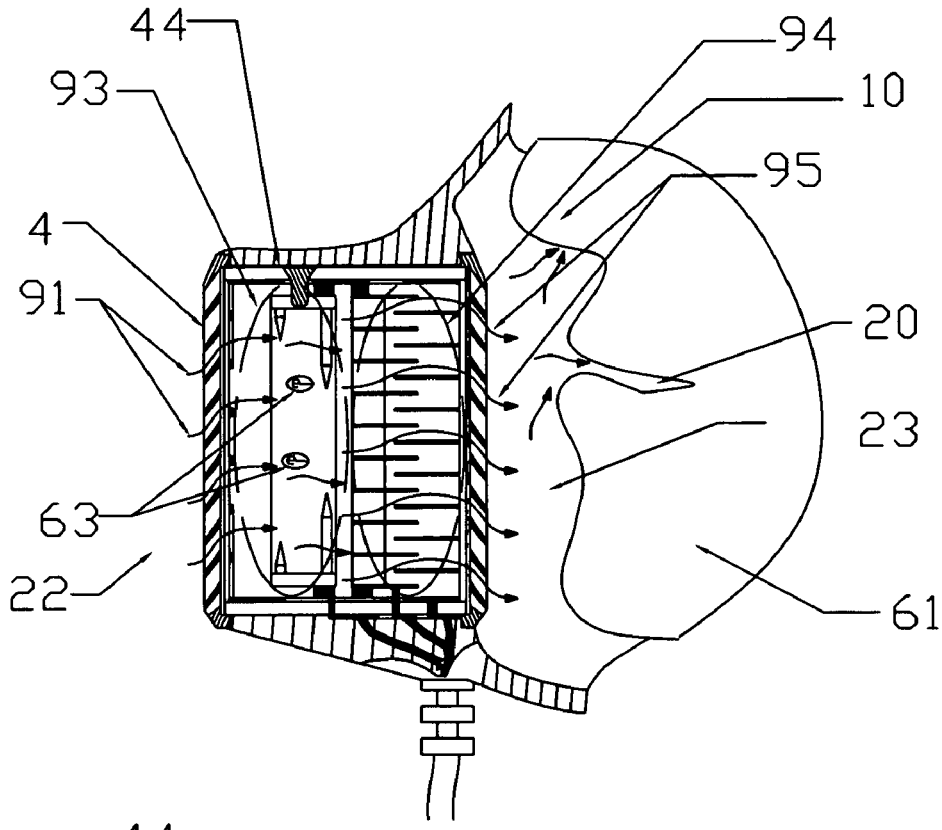
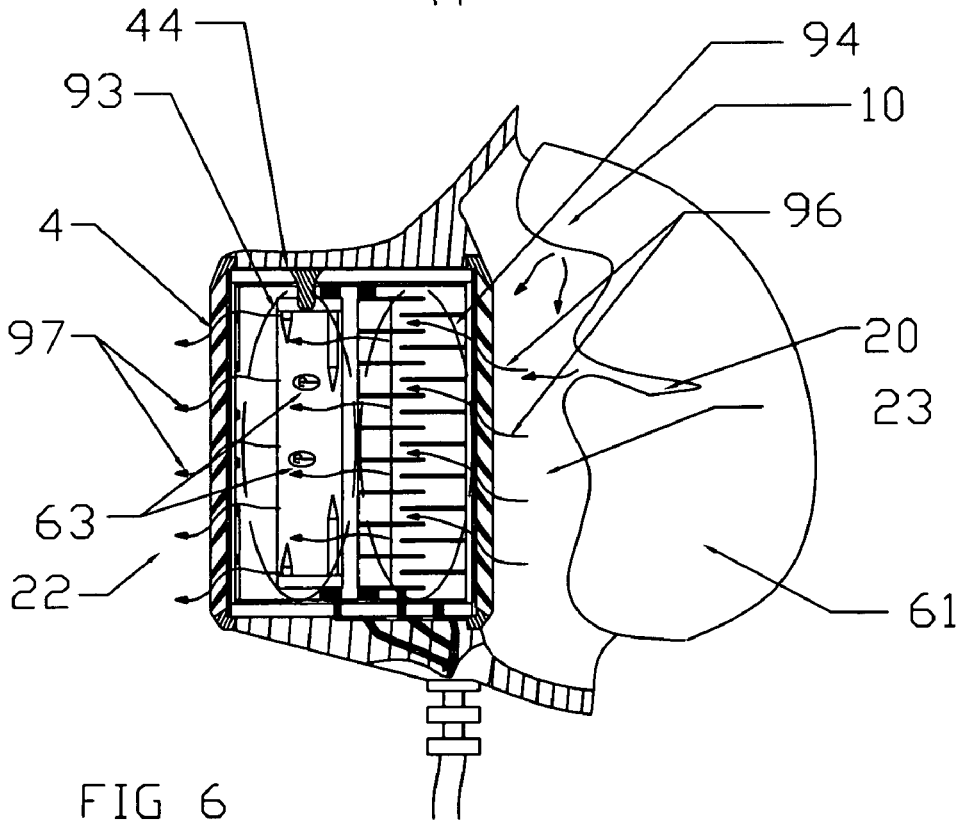
FIG 6

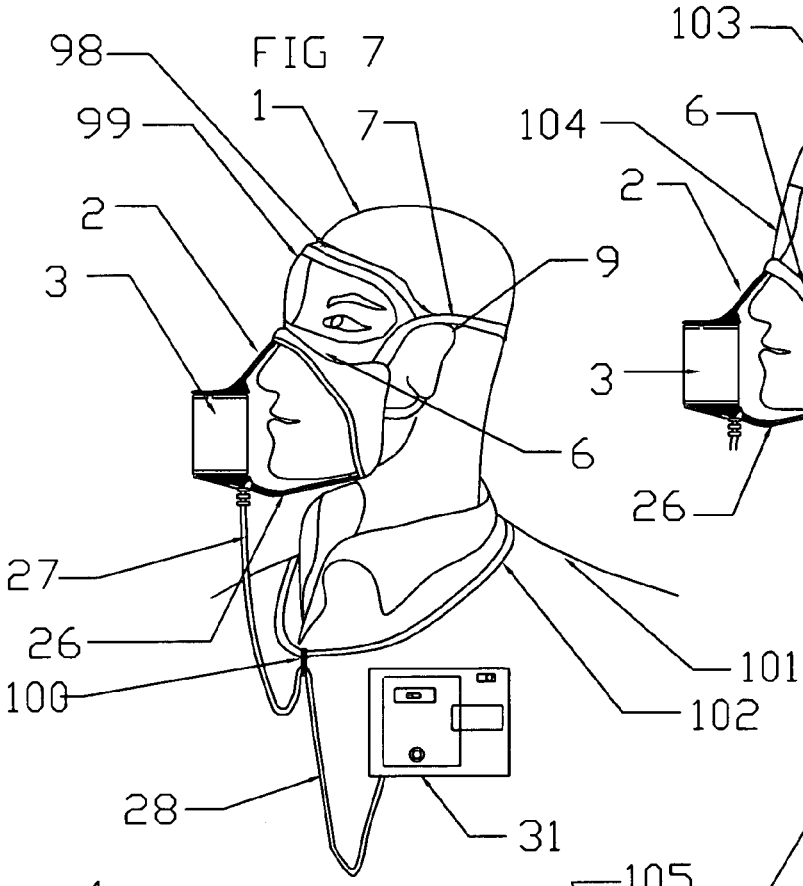
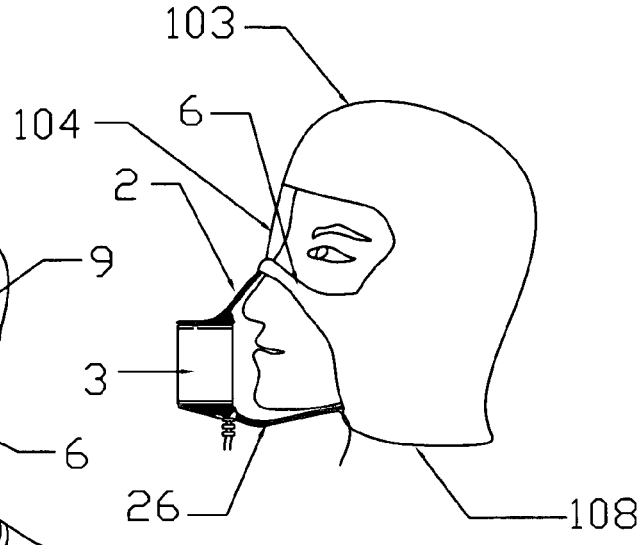
FIG 8
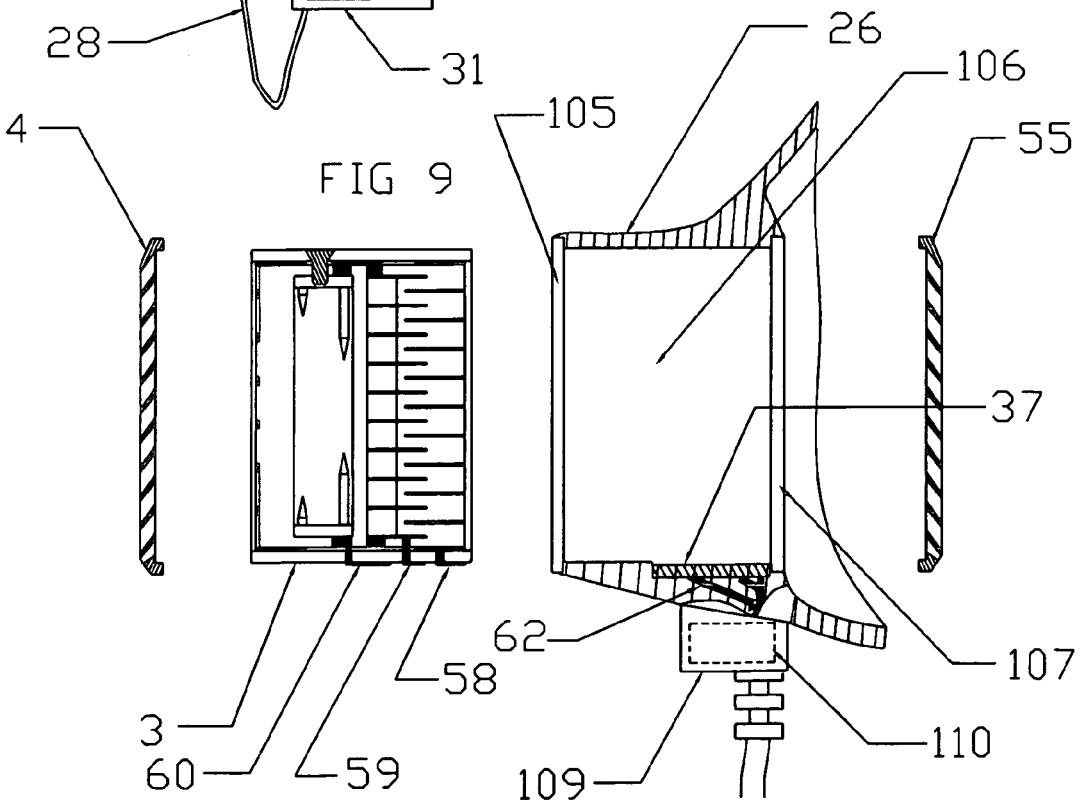

ELECTRONIC HUMAN BREATH FILTRATION DEVICE

FIELD OF INVENTION

The present invention relates to respiratory filtration nose mask with electronic air filtration system for human breath, and more particularly, a filtration device for both inhalation and exhalation breaths.

BACKGROUND OF THE INVENTION

Nose mask has been widely used in all kinds of industries from medical to industrial; from field works to home cleaning; and also in many different occasions whenever filtration of inhaling air is necessary. Usually the filter materials are of paper or fiber properties. The basic mechanism is using the human inhalation action as air suction driving force to suck the air through the filter media and stop all particles which is larger than the pores of the filtration media. It becomes very uncomfortable when someone has to wear the nose mask for an extended period of time and it is even worse if the user is kind of weak or having asthma or breathing difficulties.

Secondly, the filtration function is usually less efficient during the exhalation because the exhaust air tends to leak through the edges along the users' face rather than through the filter media.

Thirdly, the air passage resistance of the better filtration media is always higher and tougher to inhale through it.

Thus there is a need for a good inhalation and exhalation filtration system that does not exert breathing resistance to users during the normal breathing process. This filtration system shall be able to remove most of the contaminant in the air including airborne particles, bacteria and virus. The whole system shall be light enough for users to feel comfortable if wearing for extended time. It has to be very efficient in power consumption such that small consumer electronic type battery pack can support operation of the system for over a period of at least 8 hours. Easiness to clean and cost effective are also critical.

Furthermore, the filtration process shall be as efficient during both inhalation and exhalation such that if a patient is the user; the bacteria or viruses from the user breath will not get to outside ambient environment.

The present invention provides such an inhalation and exhalation filtration system nose mask.

CROSS REFERENCE TO RELATED APPLICATIONS

| Field of Search | |
|---|---|
| International Class: | A62B 23/00, 7/10 |
| U.S. Class | 128/200.24; 96/29, 54, 69, 71, 72, 75, 78, 97, 98, 100 |

U.S. Patent Documents

| | | | |
|---|---|---|---|
| 4549887 | Oct. 29, 1985 | Joannou | 96/58 |
| | This is not a human breathe cleaning device. | | |
| 5042997 | Aug. 27, 1991 | Rhodes | 96/18 |
| | This is not a human body carrying electronic breath filtering mask. | | |
| 5232478 | Aug. 3, 1993 | Farris | 96/26 |
| | This is not a human body carrying electronic breath filtering mask. | | |

-continued

| | | | |
|---|---|---|---|
| 5573577 | Nov. 12, 1996 | Joannou | 96/66 |
| | This is not a human body carrying electronic breath filtering mask. | | |
| 5690720 | Nov. 25, 1995 | Spero | 96/26 |
| | This is not a human body carrying electronic breath filtering mask. | | |
| 5846302 | Dec. 8, 1998 | Putro | 96/66 |
| | This is not a human body carrying electronic breath filtering mask. | | |
| 6245132 | Jun. 12, 2001 | Feldman | 96/28 |
| | This is not a human body carrying electronic breath filtering mask. | | |
| 6497754 | Dec. 24, 2002 | Joannou | 96/67 |
| | This is not a human body carrying electronic breath filtering mask. | | |

SUMMARY OF THE INVENTION

An electronic human breath filtration device is a human wearable light weight nose mask equipped with an absolute miniature electronic filtration system.

The unique feature of this invention is to provide a highly efficient filtration device to the user such that the air inhaled is purely clean and the exhaled air is also bacteria and virus free. The user can breathe through this filtration device without requiring extra effort as compare to sucking/breathing heavily through convention paper filter mask.

It is an object of this present invention to provide a very compact dual stages element filtration system mounted on a nose mask and utilizing small consumer electronic size battery as power source to operate this ultra high voltage ionic filtration system as well as electrostatic filtration system. It relies on the human breath as the air flow source to move the air stream through the dual stages filtration system during the inhalation and exhalation processes.

Other features and advantages of the invention will appear from the following description in which the preferred embodiments have been set forth in detail, in conjunction with the accompanying drawings.

BRIEF DESCRIPTION OF THE DRAWINGS

FIG. 5 illustrates the electronic dual filtration mechanism system during inhalation of the user.

FIG. 6 illustrates the electronic dual filtration mechanism system during exhalation of the user.

FIG. 7 illustrates the application of the present invention into face mask with eye protection incorporated with the above mentioned nose mask electronic filtration system.

FIG. 8 illustrates the application of the present invention into a hood with eye and head protection incorporated with the above mentioned nose mask electronic filtration system.

FIG. 9 illustrates the modular concept of the filtration system assembly with the voltage multiplier PCBA (printed circuit board assembly) integrated into the mask housing.

DETAILED DESCRIPTION OF THE PREFERRED EMBODIMENT

Figure 1:
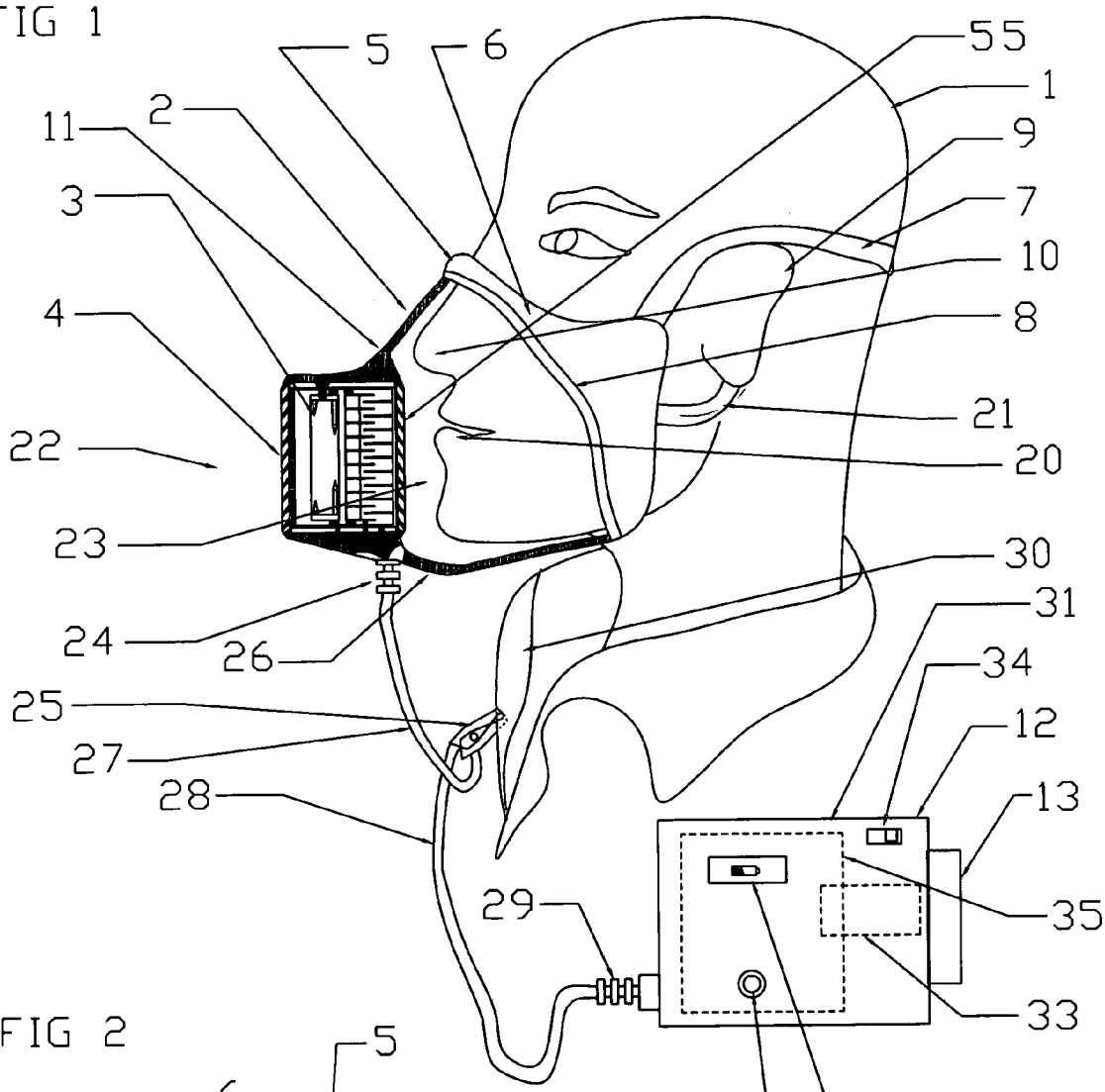
FIG. 1 is the overall diagram of the electronic inhalation and exhalation filtration device. It depicts a portion of the sectioned nose mask, a portion of the sectioned dual stages electronic filter, a portion of the sectioned front louver system, the electronic control box, the connecting cable with strain relief, a service loop clip and a user wearing the device to demonstrate the relative usage of the system according to present invention.

FIG. 1 is the overall electronic inhalation and exhalation breath filtration device system 2. The overall system 2 is comprised of 3 subsystems namely the filtration system 11, the control system 12, and the contoured mask mounting system 6.

The filtration system 11 includes the mask housing 26, a dual stages filter element module 3, a front louver cover 4 and a rear louver cover 55. This filtration system 11 is shown in cross section view and is further detailed in FIG. 3. The front louver cover 4 is mounted to the outside of the mask housing 26. The assembly can be by snap on, press-fitting, or by fastener which can facilitate the assembly means. The front louver cover 4 provides protective cover with a sufficient air passage for the air to pass from the ambient 22 to the dual stages filter element module 3 without resistance at low flow rate as human inhaling breath. It also provides a sufficient air passage for the air to pass to the ambient 22 from the dual stages filter element module 3 without resistance at low flow rate as human exhaling breath. The dual stages filter element module 3 is mounted inside the center opening of the mask housing 26. The assembly can be by snap on, press-fitting, or by fastener which can facilitate the assembly means. This dual stages filter element module 3 will filter/capture all the particles entering inside the module carried by air stream induced by breath of the user 1. The front louver cover 4 also blocks off some larger particles and rain drops from entering into the filter element module 3 as well. The rear louver cover 55 is mounted to the rear side of the mask housing 26 next to the filter element module 3. The assembly can be by snap on, press-fitting, or by fastener which can facilitate the assembly means. The rear louver cover 55 provides protective cover with a sufficient air passage for the air to pass from the mask chamber 23 to the dual stages filter element module 3 without resistance at low flow rate as human exhaling breath. It also provides a sufficient air passage for the air to pass to the mask chamber 23 from the dual stage filter element module 3 without resistance at low flow rate as human inhaling breath. The rear louver cover 55 also blocks off contaminants from sneeze and saliva of the user 1 from entering into the filter element module 3.

The mask housing 26 provides a rigid contoured shape cover the nose 10 and mouth 20 of the user 1; and a chamber to accommodate the front louver cover 4, the dual stages filter element module 3 and the rear louver cover 55. The mask housing 26, front louver cover 4 and the rear louver cover 55 can be made of metal, plastic, paper product, fiberglass or carbon fiber material. The best choice and most cost effective method of producing this mask housing 26 is by plastic molding to achieve the shape and rigidity supporting the function of the mask housing 26.

The contoured mask mounting system 6 is consisted of an elastic face-contoured seal 5, a mounting strap 7, a under ear strap 21 on each ear of the user 1. The elastic face-contoured seal 5 is assembled to the mask housing 26 by snap on, press-fitting, or by fastener which can facilitate the assembly means. It is made of elastic material such as rubber, silicon rubber, foam pad, nylon or any other material which can facilitate a soft, flexible and sealing function of the contoured seal 5. It can be made of one single piece part or an assembled piece part to facilitate the functions of the contoured seal 5. The mounting strap 7 is with both ends assembled to the contoured seal 5 or the mask housing 26. The mounting strap 7 is to be worn the way that it rests on the ears 9 of the user 1 and wraps around the back of the head of user 1. The under ear strap 21 is with one end assembled to the contoured seal 5 or the mask housing 26, and the other end assembled to the mounting strap 7 surrounding the ear of the user 1. In result, the filtration system 11 is firmly mounted to cover the mouth and nose of the user 1 with the contoured seal 5 resting on the nose and cheek of the user 1. The elastic contoured seal 5 separates the mask chamber 23 from the ambient 22 by forming a seal along the contour of the face and chin of the user 1. The dual stages element filter module 3 becomes the only air passage between the air in the mask chamber 23 and the ambient 22. The driving mechanism for the air exchange is the breathing process of user 1 with air movement from ambient 22 to mask chamber 23 caused by inhalation and air movement from mask chamber 23 to ambient 22 caused by exhalation of user 1.

The control system 12 consists of a control unit 31 which is equipped with the main PCBA (printed circuit board assembly) 35 with connection to the battery 33 and a multi-level power selector on/off switch 34. The main PCBA (printed circuit board assembly) 35 is equipped with electronic components and with the multi-level power selector on/off switch 34 set at "ON" position; the main PCBA (printed circuit board assembly) 35 will generate high negative voltage functions to activate the dual stages element filter module 3 via the connector cable 28. The connector cable 28 has a cable strain relief 24 at the connecting joint with the mask housing 26 and a cable strain relief 29 at the connecting joint with the control unit 31. The control unit 31 is also equipped with a status indicator 36 showing the status of the battery 33 supply and the level of the power setting of the switch 34. The control unit 31 is also equipped with a power adaptor input connector 32 allowing external power supply to be used or to recharge the battery 33 if rechargeable battery is being used.

An utility clip 25 is attached to the connector cable 28 and is to be used to clip onto the collar 30 or shirt of the user 1. This feature provides a section of the connector cable 28 as the service loop 27 such that only the service loop 27 portion of the connector cable 28 will move with the user 1 as the user 1 rotates or tilts his/her head while the remaining portion of the connector cable 28 will stay still. The control unit 31 is also equipped with a belt mounting clip 13 to allow the user 1 to carry the control unit 31 with a belt.

Figure 2:
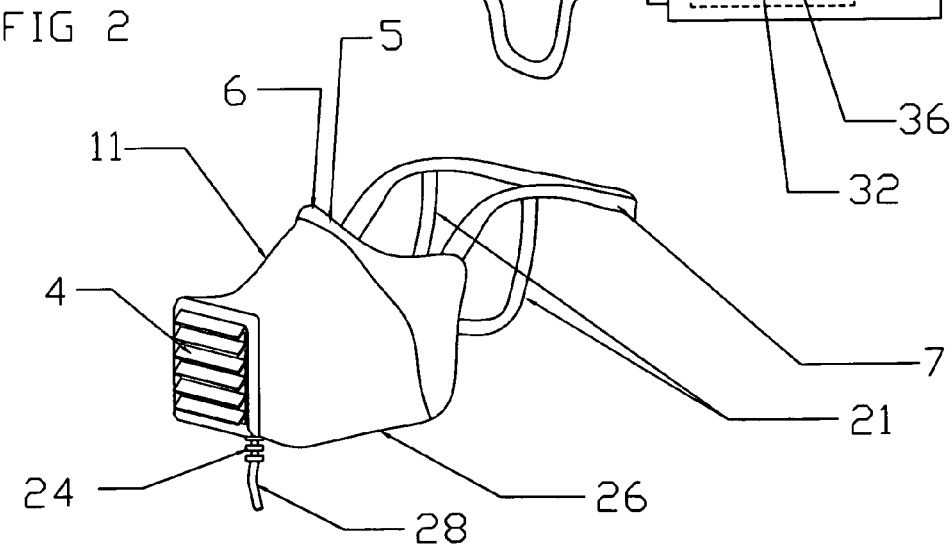
FIG. 2 illustrates the isometric front view of the filtration system with the contoured mask mounting system. It depicts the mask housing, the overall external view of the filtration system, the front louver cover, the contoured mask mounting system with the elastic face-contoured seal, the mounting strap and the under ear straps.

FIG. 2 is the front isometric view of the filtration system 11 with the contoured mask mounting system 6. The front louver cover 4 is assembled to mask housing 26 covering the front air entrance of the filtration system 11. The mounting strap 7 is supported by the elastic face-contoured seal 5 and/or the mask housing 26 at both ends. The under ear strap 21 is supported by the elastic face-contoured seal 5 and/or the mask housing 26 at one end and attached to the mounting strap 7 at the upper end. The connection cable 28 is connected to the mask housing 26 with a strain relief feature 24 right at the connection joint. The mounting strap 7 may be made of rubber, silicon rubber, nylon, nylon base cloth like material, cotton base cloth like material; and may be made up of more than one piece part for easier mounting and dismounting onto the face of the user 1.

Figure 3:
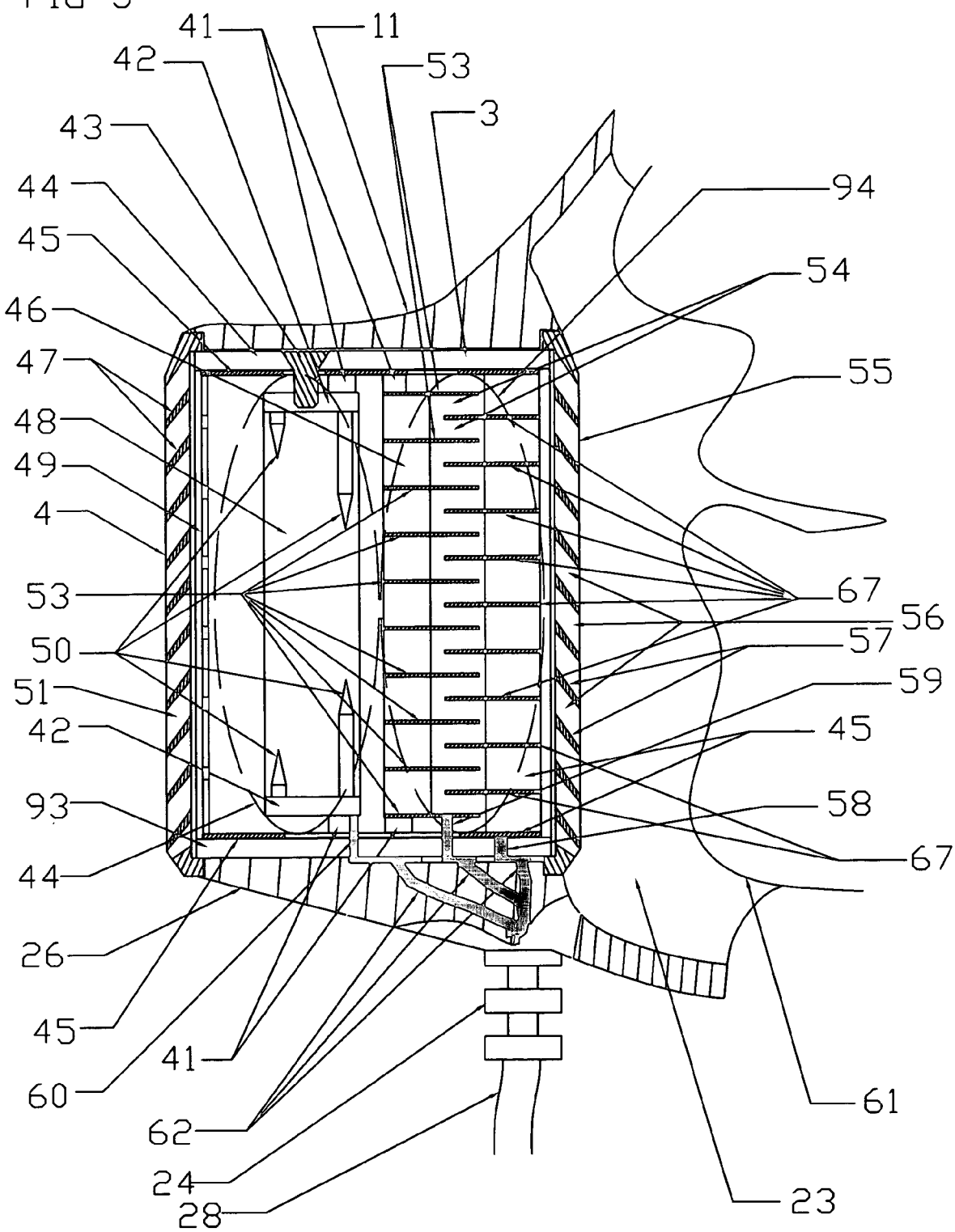
FIG. 3 is the sectioned illustration of the dual stages electronic filtration system, which depicts a portion of the front louver cover, a portion of the mask, a portion of the filter housing, a portion of the ionic stage filter, a portion of the electrostatic stage filter, a portion of the rear louver system, a portion of the electrical connection from the cable to the ionizing pins subassembly, a portion of the electrical connection from the cable to the electrostatic filter subassembly according to present invention.

FIG. 3 is the section view of the filtration system 11 with the basic structural support of the mask housing 26. The mask housing 26 is designed to contour around the mouth 20 and nose 10 of general user 1's face profile. The inner mask chamber 23 provides room for the user 1 to speak and move the lips freely without obstacle. The rear louver cover 55 is placed at the inside entrance of the dual stages element filter module 3. The louvers 57 is set at an angle such that it will block off direct blow of contaminants generated by the user 1 during sneezing, coughing, and saliva from speaking from entering into the filter module 3 while leaving generous air passages 56 for the user to breathe through without restriction or resistance. This rear louver cover 55 can be made of plastic or metallic material. It is assembled to the mask housing 26. The assembly can be by snap on, press-fitting, or by fastener which can facilitate the assembly means.

The dual stages element filter module 3 is in the middle of the mask housing 26 behind the rear louver cover 55. It is assembled to the mask housing 26. The assembly can be by snap on, press-fitting, or by fastener which can facilitate the assembly means. The dual stages element filter module 3 is comprised of two filtration system namely the ionic filtration system 93 and the electrostatic filtration system 94 enclosed in the filter housing 44. The ionic filtration system 93 consists of a highly charged negative (–) electrode 42 with sharp metallic needles 50 connected to it and the needle points of the needle 50 locating in the center portion of the ionic filtration system 93. The positively charged (+) conductive collector electrode 45 surrounds the negative electrode 42 and lines along the internal wall of the filter housing 44. The negative electrode 42 is insulated from the positive electrode conductive collector 45 by the insulator 41. The positive electrode conductive grill 49 is located at the front of the opening of the ionic filtration system 93. It is connected to the positive electrode conductive collector 45 with perforated holes over the whole surface to allow generous air passages for the user 1 to breathe through without restriction or resistance. It also serves as the positive electrode collective conductor for the negatively charged particles to adhere to. The negatively (–) charged electrode 42 is assembled to the filter housing 44 by fastener 43, which can be screw, rivet or any other mechanical fastener which can facilitate the assembly function.

Figure 4:
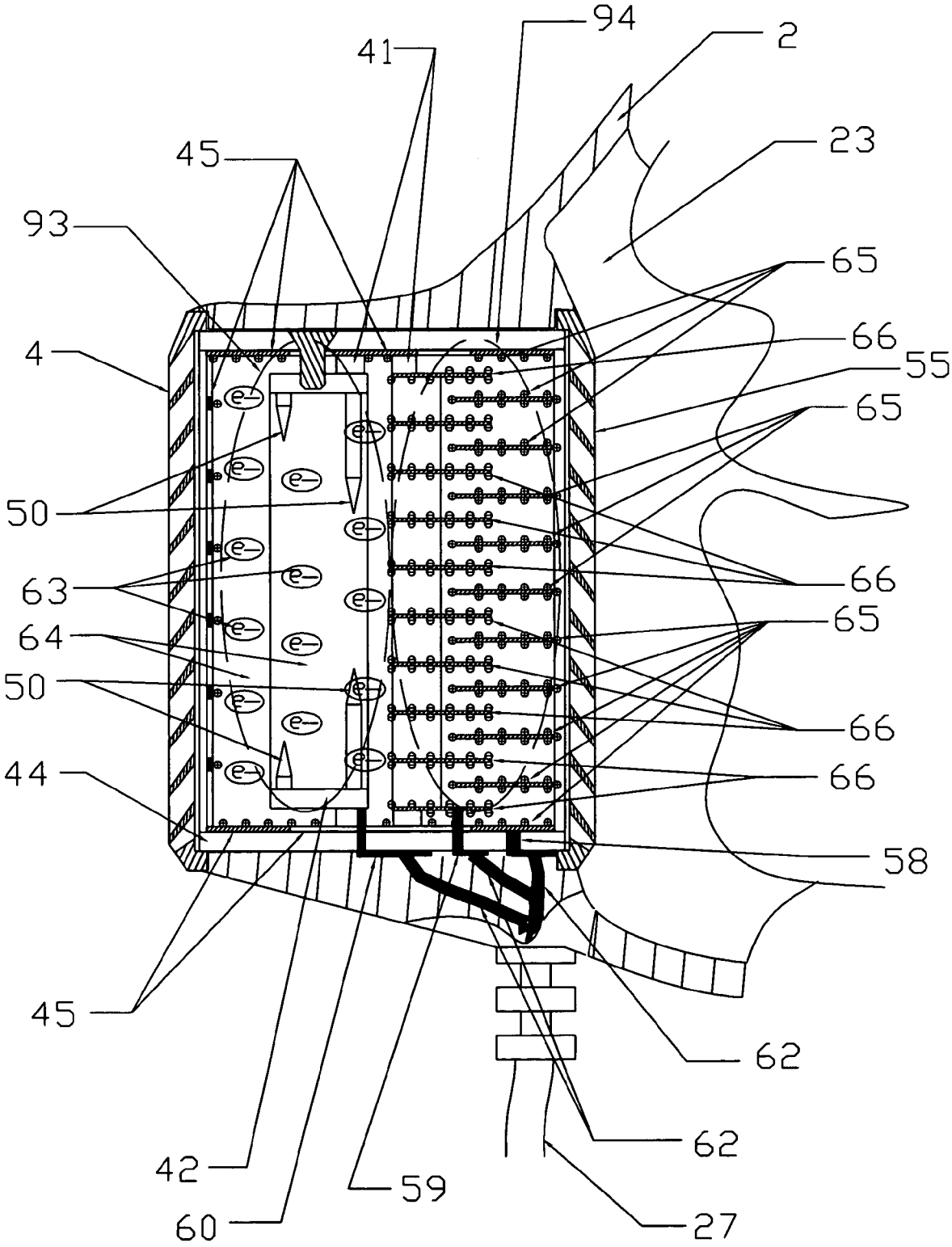
FIG. 4 is the illustration showing the sectioned view as per FIG. 3 with negative ions released by the pins forming the ionic filtration chamber and the electrostatic charges established in the electrostatic filtration chamber.

The electrostatic filtration system 94 consists of parallel sets of negatively charged electrode fins 53 sandwiching with positively charged electrode fins 67. An electrostatic field is formed between a negatively charged electrode fin 53 and positively charged electrode fin 67. The strength of the electrostatic field is determined by the gap width 54 between the two oppositely charged electrodes and the potential difference between them. Further detail explanation of the filtration processes are illustrated in FIG. 4. The negatively charged electrode fins 53 are mounted inside the filter housing 44 with the insulator 41. The positively charged electrode fins 67 are supported by the positive conductive collector 45 and are also electrically connected to the positive conductive collector 45.

The negative (–) electrode 42 of the ionic filtration system 93 is connected to the control system 12 through the cable 28 via the conductor lead 60 and the wire conductor 62 of the cable 28. The negatively charged electrode fins 53 of the electrostatic filtration system 94 are connected to the control system 12 through the cable 28 via the conductor lead 59 and the wire conductor 62 of the cable 28. The positively charged electrode fins 67 of the electrostatic filtration system 94 are connected to the control system 12 through the cable 28 via the conductor lead 58 and the wire conductor 62 of the cable 28. The electrical connection joint between the conductor lead 59, 58, 60 and the wire conductors 62 can be by contact, soldering or fastener whichever can facilitate the electrical conduction.

The cable strain relief 24 is present at the joint between the cable 28 and the mask housing 26 providing support to the cable 28 and the conductor wires 62 inside from breaking due to extensive bending and flexing action under normal usage of the breath filtration device 2.

The front louver cover 4 is placed at the outside entrance of the dual stages element filter module 3. The louvers 47 is set at an angle such that it will block off direct blow of large objects and rain from entering into the dual stages element filter module 3 while leaving generous air passages 51 for the user to breathe through without restriction or resistance. This front louver cover 4 can be made of plastic or metallic material. It is assembled to the mask housing 26. The assembly can be done by snap on, press-fitting, or by fastener which can facilitate the assembly means.

FIG. 4 is the section view of the filtration system 11 illustrating the ionization status of the ionic filtration system 93 and the electrostatic charged status of the electrostatic filtration system 94. Within the ionic filtration system 93, needle-point 50 produces high levels of negative ions 63 when high negative DC voltage is applied to it. This is the by far most effective way of ions 63 generation and will help to clean the air inside the ionic chamber 64. The negative ion generators cause an electron to be added to molecules of Oxygen, Nitrogen and other trace gases in the inhaling or exhaling air from the user 1's breath. This process creates ions with a negative charge 63. When the ions become negatively charged, they collide with airborne pollutants such as pollen, mold spores, dust, bacteria, tobacco smoke, saliva moisture, sneeze moisture and many other airborne particles. The negative charge of ion is then transferred to the airborne particles. Surrounding this newly negatively charged particle are many other particles that are positively charged. These positively charged particles are drawn to the negatively charged particle and begin to build-up, eventually these particles become too heavy and fall harmlessly to the bottom positively charged conductor collector 45. The other negatively charged airborne particles will then be attracted to the positively charged collector conductors, which include the positive conductor 45, the anode conductive grill 49 and the positively charged fin 67, when traveling along the air stream.

Small amount of ozone molecules and hydroxide molecules may also be generated in the ionic chamber 64 under very high voltage input potential. These ozone molecules and hydroxide molecules can help to fight bacteria in the air stream. The excessive ozone molecules and hydroxide molecules will be neutralized by the electrostatic filtration system 94 and will not harm the user 1.

In the electrostatic filtration system 94, a high negative voltage is induced to the negative fin 53 and the positive fin 67 is connected to the electrically positive. It results that the surface of the negative fin 53 will be highly negatively charged 66 and the causing an electrostatic field to form between the negative fin 53 and the positive fin 67, which becomes equally highly positively charged 65. This electrostatic field is an uniform electric field of force and causes an uniform distribution of electrons (negative charge 66) on the surface of negative fin 53, and an equal and uniformly distributed deficiency of electrons (positive charge 65) on the positive fin 67. The voltage graduation is uniform throughout this field, except at its edges and near sharp corners of the plates/fins.

A single positively-charged particle entering this electrostatic field is acted upon by a force equaling the sum of all attracting and repelling forces. These forces are due to the charge on the particle interacting with the field produced by the negative fin 53 and the positive fin 67. These forces accelerate the positively-charged particles towards the negatively-charged fin 53. In the same manner, a negatively charged particle is forced towards the positive fin 67. The amount of force acting on the particle depends on the particle's charge, the voltage applied to the collecting fins and the space between the fins.

The uniformity of the field causes a particle to be acted upon by an equal force regardless of whether the particle is close to a negative fin 53, to a positive fin 67, or somewhere between. If no other force is acting on the particle, it moves with a constant acceleration toward the negative fin 53.

The particles that are collected and are in physical contact with the charged collector fins lose their "opposite charge" and take on the charge of the respective collector fins. They remain attached to the collector fins because of molecular adhesion and due to cohesion to other particles already collected. As a result, contaminants are removed form the air stream of breath induced by the user 1's inhalation and exhalation efforts. In practice, the filtration system 11 will charge floating particles as small as 0.01 micron and drive them to adhere to the collector plates where they will stay for good.

FIG. 5 is the section view of the filtration system 11 with the user 1 inhaling through the filtration system 11. The inhaling breath becomes the engine to draw the air stream 92 from the mask chamber 23 into the user 1's nose 10 and mouth 20. As results, the air pressure in the mask chamber 23 will be lower than the air pressure in the electrostatic filtration system 94 and cause the air stream 95 in the electrostatic filtration system 94 to flow through the rear louver cover 55 into the mask chamber 23. In the same token the air in the ionic filtration system 93 will flow to electrostatic filtration system 94; and the air stream 91 in the ambient 22 will flow through the front louver cover 4 to the ionic filtration system 93. Eventually, during the inhalation process, the air flow from the ambient 22 through front louver cover 4, the ionic filtration system 93, the electrostatic filtration system 94 and the rear louver cover 55 into user 1's nose 10 and mouth 20. When the desirable voltage potential is applied to the filtration system 11, the ionic filtration system 93 and the electrostatic filtration system 94 will remove most of the air borne particles, contaminants and bacteria from the inhaling air stream and supplying only very clean air to the user 1. During the filtration processes, the air stream is free to move from one stage to the other and there will be no resistance induced to the inhalation effort. This is an advantage of this invention over the conventional filtration by filter material type nose mask. Weaker users 1 especially those with breathing difficulty like Asthma will find this electronic inhalation and exhalation breath filtration device system 2 very comfortable to use.

FIG. 6 is the section view of the filtration system 11 with the user 1 exhaling through the filtration system 11. The exhaling breathe becomes the engine to drive the air stream 98 from the user 1's nose 10 and mouth 20 to the mask chamber 23. As results, the air pressure in the mask chamber 23 will be higher than the air pressure in the electrostatic filtration system 94 and cause the air stream 96 in the mask chamber 23 to flow through the rear louver cover 55 into the electrostatic filtration system 94. In the same token the air in the electrostatic filtration system 94 will flow to the ionic filtration system 93; and the air stream 97 in the ionic filtration system 93 will flow through the front louver cover 4 to the ambient 22. Eventually, during the exhalation process, the air flow from the user 1's nose 10 and mouth 20 through rear louver cover 55, the electrostatic filtration system 94, the ionic filtration system 93 and the front louver cover 4 into ambient 22. When the desirable voltage potential is applied to the filtration system 11, the ionic filtration system 93 and the electrostatic filtration system 94 will remove most of the air borne particles, contaminants and bacteria from the exhaling air stream and supplying only very clean air to the ambient 22. During the filtration processes, the air stream is free to move from one stage to the other and there will be no resistance induced to the exhalation effort. This is an advantage of this invention over the conventional filtration by filter material type nose mask. The exhaling air will pass through the filtration system 11 and be filtered rather than leaking through the edges as of using paper filter nose mask where the exhaling air finds easier way out.

FIG. 7 is the front view illustrating the application of the electronic inhalation and exhalation breath filtration device system 2 being applied as a face mask with built in goggle 99 to cover and protect the eyes of the user 1. The seal 98 seals along the forehead of the user 1. The air inside the mask chamber 23 is free to flow to the chamber covered by the eye goggle 99 resulting that the air surrounds the user 1's eye is also cleaned by the dual stages element filter module 3 of the filtration system 11.

An alternative method of providing the service loop 27 is also illustrated. A mechanical clip 100 is attached to the connecting cable 28. This mechanical clip 100 is also attached to a string 102, which loops around the user 1's neck. This string 102 can be made of fabric, cloth, nylon, leather or any other material that can facilitate the function of hanging around the neck of the user 1. The mechanical clip 100 can be made of metal, plastic or any other material that can facilitate the function of mounting the control cable 28 to the string 102. The string 102 may also be used to tight directly to the connector cable 28 in the absence of the mechanical clip 100 to facilitate the mounting function of the control cable 28 and hanging around the neck of the user 1.

FIG. 8 is the front view illustrating the application of the electronic inhalation and exhalation breath filtration device system 2 being applied as a hood 103 with built in lens 104 to cover and protect the eyes and the head of the user 1. The air inside the mask chamber 23 is free to flow to the chamber covered by the lens 104 and the hood 103, resulting that the air surrounds the user 1's eye and head is also cleaned by the dual stages element filter module 3 of the filtration system 11. The bottom edge 108 of the hood 103 can be sealed along the neck of the user 1 or connected to other garment worn by the user 1.

FIG. 9 is the section view of the filtration system 11 showing the assembly of the front louver cover 4, dual stages element filter module 3 and the rear louver cover 55 with respect to the mask housing 26. An alternative to the former discussed arrangement in FIG. 3 is the addition of a PCBA (printed circuit board assembly) 110 with electronic components. This PCBA (printed circuit board assembly) 110 is installed between the cable 28 and the connector wires 62 inside the PCB (printed circuit board assembly) compartment 109. In the previous arrangement of FIG. 3, the cable 28 will carry the high voltage from the control system 13 all the way to the connector wires 62 and eventually to the dual stages element filter element 3. In this alternative arrangement, the PCBA (printed circuit board assembly) 110 is a voltage multiplier which works on the input voltage to produce a very high output voltage such that the cable 28 will only requires to carry a much lower voltage than the original arrangement. The PCBA (printed circuit board assembly) 110 receives its input voltage source from the cable 28 and sends its high voltage potential output to the connector wires 62. The connector wires 62 are connected to the connector 37. Since the system requires very low current (less than 100 mA), there are a lot of choices of small components including surface mounting components to fit into a very small form factor and not causing the mask housing 26 to be too bulky to handle by the user 1.

In the assembly the dual stages filter element module 3 will be assembled into the center cavity 106. The assembly can be performed by fastener, snap on, press-fitting or any other means that can facilitate the assembly function. In the assembly the conductor leads 58, 59 and 60 will be connected to connector 37 and receive the electrical power to operate the dual stages filter element module 3. The front louver cover 4 is to be assembled into the front cover well 105 and the rear louver cover 55 is to be assembled into the rear cover well 107 respectively.

Figure 10:
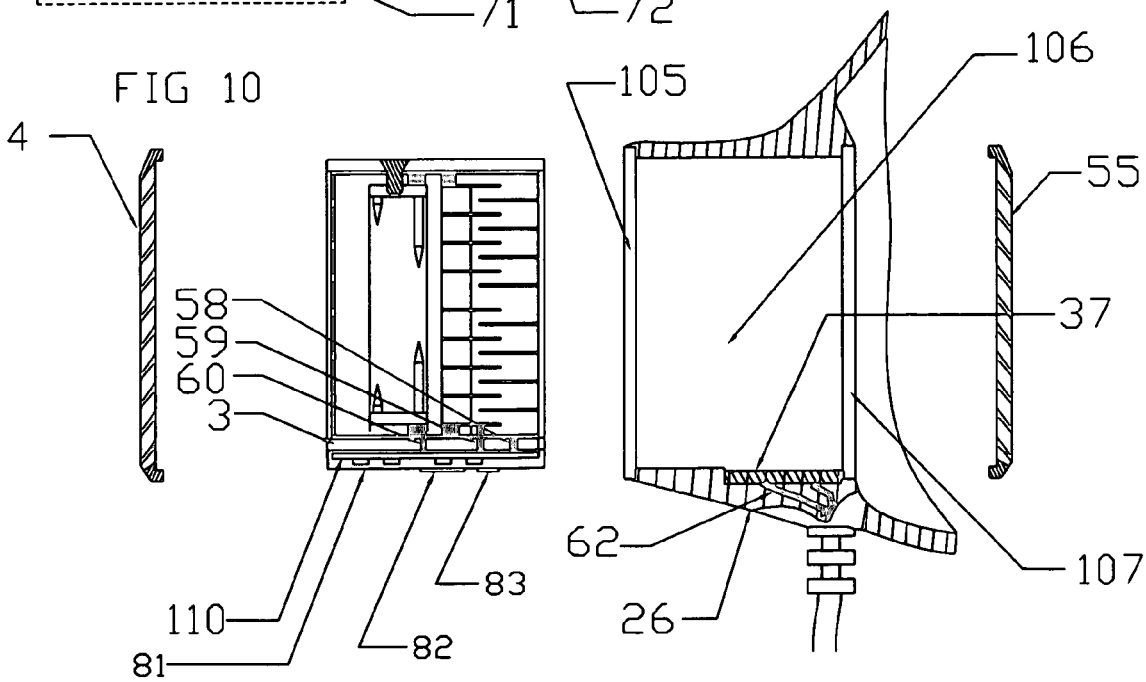
FIG. 10 illustrates the modular concept of the filtration system assembly with the voltage multiplier PCBA (printed circuit board assembly)-integrated into the electronic filter element subassembly.

FIG. 10 is the section view of the filtration system 11 showing the assembly of the front louver cover 4, dual stages element filter module 3 and the rear louver cover 55 with respect to the mask housing 26. An alternative to the former discussed arrangement in FIG. 3 and FIG. 9 is the integration of the PCBA (printed circuit board assembly) 110 with electronic components to be part of the electronic dual stages element filter module 3. All the electronic components on the PCBA (printed circuit board assembly) 110 are encapsulated 81 with encapsulation resin to protect the PCBA (printed circuit board assembly) 110 from electrical shorting. The lead conductors 82 and 83 are connected to connector 37, which is connected to the main PCBA (printed circuit board assembly) 35 of the control system 12 through the connector wires 62 of cable 28. The PCBA (printed circuit board assembly) 110 receives the input power from main PCBA (printed circuit board assembly) 35 through the lead conductors 82 and 83 with conductor 82 connected to the positive charge and the conductor 83 connected to the negative charge of main PCBA (printed circuit board assembly) 35. It performs the voltage multiplier function and sends the high voltage output to the electronic dual stages element filter element module 3 through the lead conductor 58, 59 and 60 respectively.

In this alternative arrangement, the PCBA (printed circuit board assembly) 110 is a voltage multiplier which works on the input voltage to produce a very high output voltage directly to the electronic dual stages element filter module 3 and minimizes the potential drop; resulting that the cable 28 is only required to carry much lower voltage than original arrangement as in FIG. 3. Since the system requires very low current (less than 100 mA), there are a lot of choices of small components including surface mounting components to fit into a very small form factor and not causing the mask housing 26 to be too bulky to handle by the user 1.

In the assembly the dual stages filter element module 3 will be assembled into the center cavity 106. The assembly can be performed by fastener, snap on, press-fitting or any other means that can facilitate the assembly function. In the assembly the conductor leads 82 and 83 will be connected to connector 37 and receive the input electrical power for the voltage multiplier PCBA (printed circuit board assembly) 110 to generate high voltage to operate the dual stages filter element module 3. The front louver cover 4 is to be assembled into the front cover well 105 and the rear louver cover 55 is to be assembled into the rear cover well 107 respectively.

Figure 11:
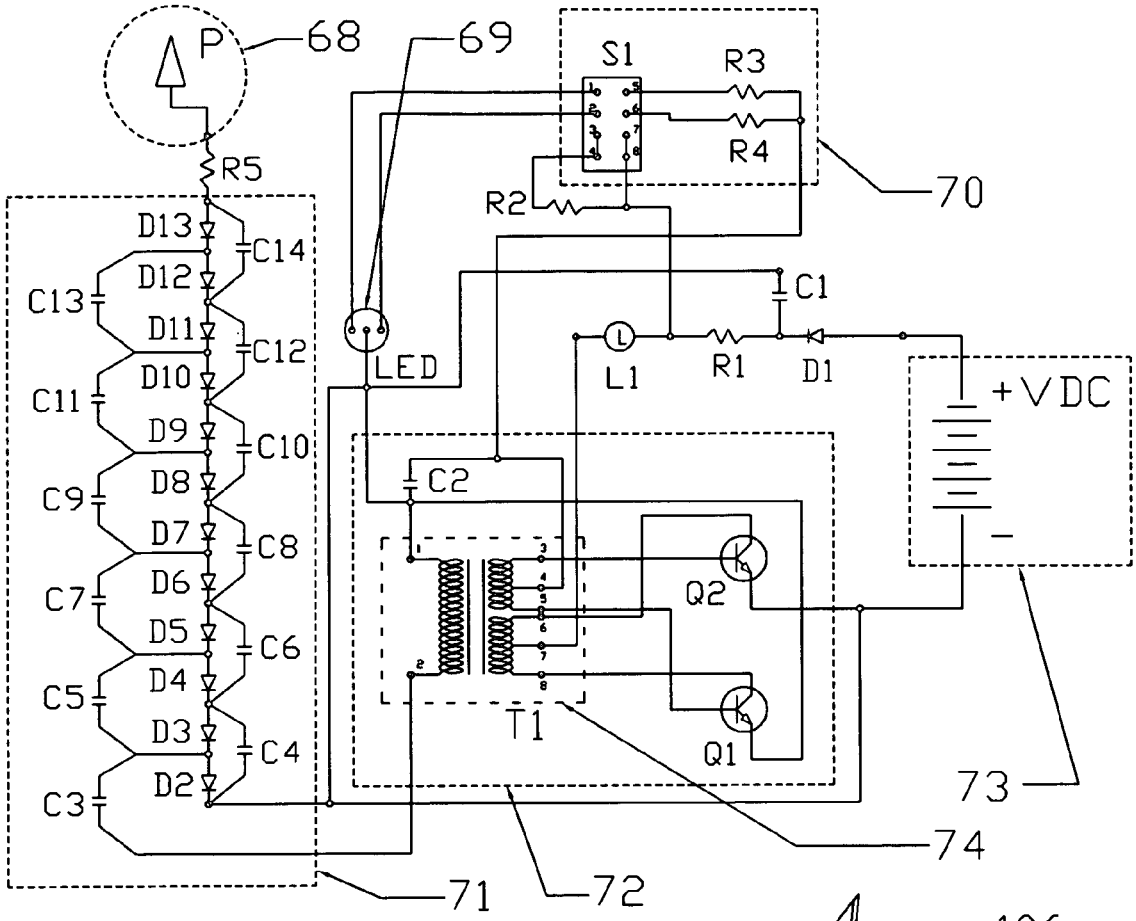
FIG. 11 is the electronic circuit of generating a high voltage output to operate a dual stages electronic filtration device with a low voltage battery source.

FIG. 11 is the circuit diagram illustrating the high voltage power supply source that drives the dual stages element filtration system 3. A low voltage battery 33 supplies power through a power level selector circuit 70 to an oscillator stage circuit 72. The output is then stepped-up by transformer (T1) 74, which in turn feeds the input of voltage to the voltage multiplier 71. The high voltage output 68 from the voltage multiplier 71 is then sent to the needle points 50 where ionization occurs in the ionic filtration system 93. The high voltage output 68 is also sent to the negatively charged fins 53 of the electrostatic filtration system 94. The power selector circuit 70 allows the user 1 to select one of the preset voltage levels at the high voltage output 68, which also represents the rate of ionic activities with respect to the ambient surroundings. User 1 can use a power saving mode or a high reaction rate filtration mode if the surrounding is dusty. Experiment shows the power consumption rate is less than 40 mA at 12 VDC power supply. As a result, a 1200 mAH battery pack of 12 VDC may support the breath filtration system 2 to operate for over 24 hours.

It will be appreciated that the sizes, quantities, shapes and dispositions of various components like needlepoint ionization pins, electrode fins, electro-collectors, louver covers, conductor leads, wires, cable length, material use, filter size, filter gap clearance, size of the mask and size of the seal can be varied, without departing from the spirit and scope of the invention. Similarly, the sizes and contour of the nose mask, face mask and hood with reference to adult, children, male and female, and the like may be varied. While the methods of connecting the service loop of the cable are illustrated, other methods may instead be used to facilitate the concept of service loop. While the methods of mounting the mask-filter system with straps concept is illustrated, other methods may instead be used to facilitate the concept of mounting to the user's face. While this electronic inhalation and exhalation breath filtration device system has been described with respect to application to nose mask, face mask and hood, the described system may also apply to other human wearing electronic filtration systems and may have more than one air inlet or air outlet.

Modifications and variations may be made to the disclosed embodiments without departing from the subject and spirit of the invention as defined by the following claims.

What is claimed is:

1. A portable electronic human breath filtration device adapted to be carried on a human body, comprising a filtration apparatus which is adapted to interact with human inhalation and exhalation efforts as energy source to drive the breathing air of the user through the said filtration apparatus and is further comprised of a mask module including a mask chamber adapted to surround the nose and mouth of a user and a filter chamber for an electronic filter element to be installed;

a seal, which is supported by the mask module, separates the mask chamber from the ambient by forming a sealing edge along the edge of the mask module and the skin surface of the user when the said device is being adapted to be worn onto the face by the user;

a mounting strap, which is supported by the mask module is adapted to be wrapped above the ears and around the back of the head of the user to keep the mask module covering the nose and mouth of the user;

two under ear straps, with one at each side, are supported by the mask module on one end and the other end attached to the mounting strap to increase stability of the mask module when being adapted to be worn on the face of the user;

an electronic filter element is installed inside the filter chamber of the mask module;

a front louver cover with slotted holes covers the front entrance of the electronic filter element is mounted to the front side of the mask module;

a rear louver cover with slotted holes covers the back entrance of the electronic filter element is mounted to the inside of the mask module;

a control system including a printed circuit board assembly, electronic components and battery to provide electronic functions to operate the said electronic filter element and;

a connection cable connects the said electronic filter element to the said control system.

2. The apparatus of claim 1, wherein said control system of the portable electronic human breath filtration device adapted to be carried on a human body comprises a main printed circuit board assembly with electronic components, which also includes a high voltage power supply generating electronic components;

a battery connected to the said main printed circuit board assembly to supply power to the said control system;

a connector connected to the said main printed circuit board assembly to allow alternative usage of external power supply instead of the said battery;

a multi-power level selector on/off switch connected to the said main printed circuit board assembly to allow the user to select the preset power levels of the said control system;

a status indicator connected to the said main printed circuit board assembly to show the charge level of the battery, the power level setting selected and if the power is on;

an enclosure housing for all the above components to be mounted to;

a belt clip attached to the said enclosure housing to allow user to carry the said control system with a belt.

3. The apparatus of claim 2, wherein said high voltage power supply electronic components of the said main printed circuit board assembly of the portable electronic human breath filtration device adapted to be carried on a human body comprises a direct current DC power supply stage;

an oscillator stage powered by said direct current power supply;

a step-up transformer having a primary and at least one secondary winding, said primary winding forming an output of said oscillator stage;

a voltage multiplier stage having an input and an output with the said input of the said voltage multiplier being connected to the output of the oscillator stage; and the said output of the said voltage multiplier forms an output of said high voltage power supply.

4. The apparatus of claim 3, wherein said voltage multiplier stage is a separate printed circuit board assembly from the said main printed circuit board assembly of the said control system.

5. The apparatus of claim 4 wherein said voltage multiplier stage is mounted to the said mask module of the portable electronic human breath filtration device adapted to be carried on a human body.

6. The apparatus of claim 4 wherein said voltage multiplier stage is an integrated part of the said electronic filter element of the portable electronic human breath filtration device adapted to be carried on a human body.

7. The apparatus of claim 1, wherein said electronic filter element of the portable electronic human breath filtration device adapted to be carried on a human body is a dual stages electronic filtration element which comprises an ionic filtration stage filter element;

an electrostatic filtration stage filter element.

8. The apparatus of claim 7, wherein said ionic filtration stage filter element comprises a conducting collector element;

an electrical coupling means for receiving an electric potential from a high voltage source;

an ionizing element comprising an electrically conductive material having needle-pointed ends for providing a high potential gradient to ionize particle components of a gas passing there-through, said conducting collector element and ionizing element being connected to the electrical coupling means to produce said high potential gradient when supplied with charge from a high voltage source through said electrical coupling means.

9. The apparatus of claim 8, wherein said electrically conductive material having needle-pointed ends is interchangeable with conductive metal-coated fine non-metallic filaments.

10. The apparatus of claim 8, wherein said ionic filtration stage filter element is in combination with a voltage power supply which provides a potential between the ionizing element and the conducting collector element with minimum of 5000 volts.

11. The apparatus of claim 7, wherein said electrostatic filtration stage filter element comprises an electrical coupling means for receiving an electric potential from a high voltage source;

a first conductor electrode, which is connected to a positively charged pole of the said electrical coupling means;

a second conductor electrode, which is connected to a negatively charged pole of the said electrical coupling means, produces an electrostatic field between the said first conductor electrode and the said second conductor electrode due to the production of said high potential gradient when supplied with charge from a high voltage source through said electrical coupling means.

12. A dual stage electronic filtration system, which comprises of an ionic filtration stage electronic filtration system, which is further comprised of a conducting collector element;

an electrical coupling means for receiving an electric potential from a high voltage source;

an ionizing element comprising an electrically conductive material having needle-pointed ends for providing a high potential gradient to ionize particle components of a gas passing there-through, said conducting collector element and ionizing element being connected to the electrical coupling means to produce said high potential gradient when supplied with charge from a high voltage source through said electrical coupling means;

and an electrostatic filtration stage electronic filtration system which is further comprised of an electrical coupling means for receiving an electric potential from a high voltage source;

a first conductor electrode, which is connected to a positively charged pole of the said electrical coupling means;

a second conductor electrode, which is connected to a negatively charged pole of the said electrical coupling means, produces an electrostatic field between the said first conductor electrode and the said second conductor electrode due to the production of said high potential gradient when supplied with charge from a high voltage source through said electrical coupling means;

wherein particles are removed from, air borne particles, dust, pollens, contaminants, bacteria, viruses, toxic chemical, fume and tobacco smoke by the system which is adapted to be carried on a human body including a mask module having a mask chamber adapted to surround the nose and mouth of a user and a filter chamber where said first and second conductor electrodes are installed and is adapted to directly interact with human inhalation and exhalation breaths such that all inhalation and exhalation breaths pass through the mask module.

13. The apparatus of claim 1, wherein said electronic filter element of the portable electronic human breath filtration device adapted to be carried on a human body is an ionic filtration stage filter element, which comprises a conducting collector element;

an electrical coupling means for receiving an electric potential from a high voltage source;

an ionizing element comprising an electrically conductive material having needle-pointed ends for providing a high potential gradient to ionize particle components of a gas passing there-through, said conducting collector element and ionizing element being connected to the electrical coupling means to produce said high potential gradient when supplied with charge from a high voltage source through said electrical coupling means.

14. The apparatus of claim 13, wherein said ionic filtration stage filter element is in combination with a voltage power supply which provides a potential between the ionizing element and the conducting collector element with minimum of 5000 volts.

15. An ionic filtration stage electronic filtration system which is further comprised of a conducting collector element;

an electrical coupling means for receiving an electric potential from a high voltage source;

an ionizing element comprising an electrically conductive material having needle-pointed ends for providing a high potential gradient to ionize particle components of a gas passing there-through, said conducting collector element and ionizing element being connected to the electrical coupling means to produce said high potential gradient when supplied with charge from a high voltage source through said electrical coupling means;

wherein particles are removed from, air borne particles, dust, pollens, contaminants, bacteria, viruses, toxic chemical, fume and tobacco smoke by the system which is adapted to be carried on a human body including a mask module having a mask chamber adapted to surround the nose and mouth of a user and a filter chamber where said ionizing element is installed and is adapted to directly interact with human inhalation and exhalation breaths such that all inhalation and exhalation breaths pass through the mask module.

16. The apparatus of claim 13, wherein said electrically conductive material having needle-pointed ends is interchangeable with conductive metal-coated fine non-metallic filaments.

17. The apparatus of claim 1, wherein said electronic filter element of the portable electronic human breath filtration device adapted to be carried on a human body is an electrostatic filtration stage filter element.

18. The apparatus of claim 17, wherein said electrostatic filtration stage filter element comprises an electrical coupling means for receiving an electric potential from a high voltage source;

a first conductor electrode, which is connected to a positively charged pole of the said electrical coupling means;

a second conductor electrode, which is connected to a negatively charged pole of the said electrical coupling means, produces an electrostatic field between the said first conductor electrode and the said second conductor electrode due to the production of said high potential gradient when supplied with charge from a high voltage source through said electrical coupling means.

19. An electrostatic filtration stage electronic filtration system which is further comprised of an electrical coupling means for receiving an electric potential from a high voltage source;

a first conductor electrode, which is connected to a positively charged pole of the said electrical coupling means;

a second conductor electrode, which is connected to a negatively charged pole of the said electrical coupling means, produces an electrostatic field between the said first conductor electrode and the said second conductor electrode due to the production of said high potential gradient when supplied with charge from a high voltage source through said electrical coupling means;

wherein particles are removed from, air borne particles, dust, pollens, contaminants, bacteria, viruses, toxic chemical, fume and tobacco smoke by the system which is adapted to be carried on a human body including a mask module having a mask chamber adapted to surround the nose and mouth of a user and a filter chamber where said first and second conductor electrodes are installed and is adapted to directly interact with human inhalation and exhalation breaths such that all inhalation and exhalation breaths pass through the mask module.

20. The apparatus of claim 1, wherein said a portion of the said connection cable of a portable electronic human breath filtration device adapted to be carried on a human body is set up as a service loop such that only this said portion of the connection cable will be swinging around, bending and stretching when the user, who has adapted to wear the said mask module on his/her face, moves his/her head.

21. The apparatus of claim 20 wherein said service loop is accomplished by a mechanical device which provides attachment means to the said connection cable and mounting means adapted to the user's body and/or clothing.

22. The apparatus of claim 1 wherein said rear louver cover provides resistance and blockage of flow of body fluid from the user's mouth and nose directly into the said electronic filter element caused by sneezing, coughing, and speech by the user.

23. The apparatus of claim 1 wherein said electronic filter element of the portable electronic human breath filtration device adapted to be carried on a human body may generate small amount of ozone molecules during operation when high voltage is supplied.

24. The apparatus of claim 1 wherein said electronic filter element of the portable electronic human breath filtration device adapted to be carried on a human body may generate small amount of hydroxide molecules during operation when high voltage is supplied.

25. The apparatus of claim 3 wherein said oscillator stage is further comprised of electronic components that converts a DC power source of said direct current DC power supply stage into a pulsating/oscillating DC power source as an input power source to said step-up transformer of the portable human body carrying electronic human breath filtration device which is adapted to be carried on a human body and is adapted to interact with human inhalation and exhalation breaths.

26. The apparatus of claim 25 wherein said step-up transformer is further comprised of at least one primary winding and at least one secondary winding to transform said pulsating/oscillating DC power source input to a higher voltage output of a high voltage power supply source of a portable human body carrying electronic human breath filtration device which is adapted to be carried on a human body and is adapted to interact with human inhalation and exhalation breaths.

27. The apparatus of claim 26 wherein said voltage multiplier stage is further comprised of electronic components to form a voltage multiplier circuit that multiplies an input voltage generated by the said step-up transformer to a high voltage output of a high voltage power supply source of the portable human body carrying electronic human breath filtration device which is adapted to be carried on a human body and is adapted to interact with human inhalation and exhalation breaths; the voltage multiplier circuit is defined as using multiple stages of capacitor and diode cascade circuit to multiply the said input voltage to an output voltage of at least 2 times an input voltage potential.

28. The apparatus of claim 4 wherein the electronic components of the said voltage multiplier printed circuit board assembly are encapsulated in encapsulation resin to allow the spaces between components to be smaller and will not be electrically shorted.

* * * * *